US009699582B2

(12) United States Patent
Sheerin et al.

(10) Patent No.: US 9,699,582 B2
(45) **Date of Patent: *Jul. 4, 2017**

(54) SELF CALIBRATING MULTI-ELEMENT DIPOLE MICROPHONE

(71) Applicant: VOCOLLECT, Inc, Pittsburgh, PA (US)

(72) Inventors: John Sheerin, Pittsburgh, PA (US); Richard Sharbaugh, Upper Burrell, PA (US); Matthew Shope, Beaver Falls, PA (US)

(73) Assignee: VOCOLLECT, Inc., Pittsburgh, PA (US)

( * ) Notice: Subject to any disclaimer, the term of this patent is extended or adjusted under 35 U.S.C. 154(b) by 273 days.

This patent is subject to a terminal disclaimer.

(21) Appl. No.: 14/468,420

(22) Filed: Aug. 26, 2014

(65) Prior Publication Data

US 2014/0369511 A1 Dec. 18, 2014

Related U.S. Application Data

(63) Continuation of application No. 13/090,531, filed on Apr. 20, 2011, now Pat. No. 8,824,692.

(51) Int. Cl.

| | |
|---|---|
| ***H04R 29/00*** | (2006.01) |
| *H04R 1/10* | (2006.01) |
| *H04R 3/00* | (2006.01) |

(52) U.S. Cl.

CPC ..... *H04R 29/004* (2013.01); *H04R 1/1083* (2013.01); *H04R 3/005* (2013.01)

(58) Field of Classification Search

CPC ..... H04R 29/004; H04R 1/1083; H04R 3/005

USPC ..... 381/58, 122, 92

See application file for complete search history.

(56) References Cited

U.S. PATENT DOCUMENTS

| | | | | |
|---|---|---|---|---|
| 5,029,215 | A * | 7/1991 | Miller, II | H04R 1/38 367/13 |
| 5,200,610 | A | 4/1993 | Zuckerwar et al. | |
| 5,567,863 | A * | 10/1996 | Larson | H04R 29/001 367/13 |
| 5,844,994 | A | 12/1998 | Graumann | |
| 6,914,989 | B2 | 7/2005 | Janse et al. | |
| 7,139,400 | B2 | 11/2006 | Stuart | |
| 8,009,840 | B2 | 8/2011 | Kellermann et al. | |
| 2004/0165735 | A1 * | 8/2004 | Opitz | H04R 1/406 381/92 |

(Continued)

*Primary Examiner* — Vivian Chin
*Assistant Examiner* — Ammar Hamid
(74) *Attorney, Agent, or Firm* — Additon, Higgins & Pendleton, P.A.

(57) ABSTRACT

A self calibrating dipole microphone formed from two omni-directional acoustic sensors. The microphone includes a sound source acoustically coupled to the acoustic sensors and a processor. The sound source is excited with a test signal, exposing the acoustic sensors to acoustic calibration signals. The responses of the acoustic sensors to the calibration signals are compared by the processor, and one or more correction factors determined. Digital filter coefficients are calculated based on the one or more correction factors, and applied to the output signals of the acoustic sensors to compensate for differences in the sensitivities of the acoustic sensors. The filtered signals provide acoustic sensor outputs having matching responses, which are subtractively combined to form the dipole microphone output.

20 Claims, 4 Drawing Sheets

(56) References Cited

U.S. PATENT DOCUMENTS

2011/0288860 A1* 11/2011 Schevciw ..... G10L 25/78
704/233

* cited by examiner

SELF CALIBRATING MULTI-ELEMENT DIPOLE MICROPHONE

CROSS-REFERENCE TO RELATED APPLICATION

The present application claims the benefit of U.S. patent application Ser. No. 13/090,531 for a Self Calibrating Multi-Element Dipole Microphone filed Apr. 20, 2011 (and published Oct. 25, 2012 as U.S. Patent Application Publication No. 2012/0269356), now U.S. Pat. No. 8,824,692. Each of the foregoing patent application, patent publication, and patent is hereby incorporated by reference in its entirety.

FIELD OF THE INVENTION

The present invention relates generally to microphone assemblies, and more specifically, to dipole microphone assemblies utilizing multiple acoustic sensor elements.

BACKGROUND

Microphones are used in a variety of different devices and applications. For example, microphones are used in headsets, cell phones, music and sound recording equipment, sound measurement equipment and other devices and applications. In one particular application, headsets with microphones are often employed for a variety of purposes, such as to provide voice communications in a voice-directed or voice-assisted work environment. Such environments use speech recognition technology to facilitate work, allowing workers to keep their hands and eyes free to perform tasks while maintaining communication with a voice-directed portable computer device or larger system. A headset for such applications typically includes a microphone positioned to pick up the voice of the wearer, and one or more speakers positioned near the wearer's ears so that the wearer may hear audio associated with the headset usage. Headsets may be coupled to a mobile or portable communication device that provides a link with other mobile devices or a centralized system, allowing the user to maintain communications while they move about freely.

Work environments in voice-directed or voice-assisted systems are often subject to high ambient noise levels, such as those encountered in factories, warehouses or other worksites. High ambient noise levels may be picked up by the headset microphone, masking and distorting the speech of the headset wearer so that it becomes difficult for other listeners to understand or for speech recognition systems to process the audio signals from the microphone. To maintain speech intelligibility in the presence of high ambient noise levels, it is therefore desirable to increase the ratio of speech energy to ambient noise energy—or the signal to noise ratio (SNR)—of the audio transmitted from the headset by reducing the sensitivity of the microphone to ambient noise levels while maintaining or increasing its sensitivity to the acoustic energy created by the headset wearer's voice.

Microphones designed to suppress ambient noise in favor of user speech are commonly known as noise cancellation microphones. One type of noise cancellation microphone is a dipole microphone, which is also sometimes referred to as a bi-directional, or FIG. 8 microphone. Unlike an omni-directional microphone, which is strictly sensitive to the absolute air pressure at the microphone, a dipole microphone generates output signals in response to air pressure gradients across the microphone.

High quality dipole microphones may be constructed using a single element, such as a ribbon or diaphragm. To make the microphone sensitive to pressure gradients, both sides of the diaphragm are exposed to the ambient environment, so that the diaphragm moves in response to the difference in pressure between its front and back. Acoustic waves arriving from the front or back of the diaphragm will thus be picked up with equal sensitivity, with acoustic waves arriving from the back producing output signals with an opposite phase as those arriving from the front. In contrast, acoustic waves arriving from the side produce equal pressure on both the front and back of the diaphragm, so that the diaphragm does not move, and thus the microphone does not produce an output signal. For this reason, a well designed single-diaphragm dipole microphone may have a deep response null to acoustic waves arriving at an angle of 90° degrees to the forward or reverse pickup axes.

Although single element dipole microphones may offer excellent performance, they are expensive, which can drive up the cost of devices, such as headsets, employing them as a noise cancelling microphone. A less costly way of constructing a dipole microphone is to space two lower cost omni-directional acoustic sensors a distance apart, and electrically connect the sensors so that their output signals are added together out of phase. Acoustic waves causing a pressure gradient across the dipole pair—such as acoustic waves arriving lengthwise with respect to the dipole pair—will result in each acoustic sensor generating a different output signal, so that the resulting differential output of the dipole pair will be non-zero. Acoustic waves that produce the same absolute pressure at each acoustic sensor—such as acoustic waves arriving from the side, or low frequency far field acoustic waves—will cause each omni-directional acoustic sensor to produce the same output signal so that the resulting differential sum is zero. Thus, similarly to a single element dipole microphone, a dipole microphone consisting of a pair of omni-directional acoustic sensors is sensitive to the pressure gradient across the microphone rather than the absolute sound pressure level at the microphone.

The pressure gradient sensitivity of a dipole microphone makes it particularly well suited for use as a noise cancelling microphone on a headset. Because a headset microphone is typically in close proximity to the wearer's mouth, the microphone is in what is commonly referred to as a near field condition with respect to the wearer's voice. Near field conditions typically result in acoustic waves that are generally spherical in shape with a small radius of curvature when in close proximity to the source of the acoustic energy. Because a spherical acoustic wave's intensity has an inverse relationship to the logarithm of the distance from the source, the sound pressure at each acoustic sensor of a multi-element dipole microphone in this near field condition may be substantially different, creating a large pressure gradient across the microphone. As acoustic waves propagate a greater distance from their source, the sound pressure in the wave does not decrease as rapidly over a given distance, such as the distance between the acoustic sensors of a multi-element dipole microphone. Therefore, a much smaller pressure gradient is created across the microphone by acoustic waves originating from more distance sources, so that the microphone is generally less sensitive to these distant sources.

The pressure gradients generated across the microphone are also affected by the phase difference between the acoustic waves arriving at the two acoustic sensors. Because the acoustic sensors are separated by a short distance, the sound pressures at each sensor will have a phase difference that depends in part on the wavelength of the incident acoustic wave. Acoustic waves having shorter wavelengths will thus generally cause the microphone to experience a higher degree of phase difference between the acoustic sensors than lower frequency waves, since the distance separating the sensors will be a larger fraction of the higher frequency wavelength. Because—for wavelengths within the design bandwidth of the microphone—this phase difference tends to increase the pressure difference between the acoustic sensors, lower frequency acoustic waves (which produce a lower phase difference) may experience a higher degree of cancellation in a multi-element dipole microphone than high frequencies.

Speech from the headset wearer also has the characteristic that it arrives at the microphone from a particular fixed direction. This is opposed to ambient noise, which may arrive from any direction. As previously discussed, the dipole microphone's sensitivity to pressure gradients makes it sensitive to acoustic waves arriving along the axis of the microphone; but causes it to produce relatively little output for acoustic waves arriving from the sides. By using a dipole microphone aligned with the headset wearer's mouth, further ambient noise reduction may be achieved due to the dipole microphone having lower sensitivity to ambient sounds arriving from the side.

To function properly as a dipole microphone, the omni-directional sensors must be matched, so that each sensor produces an output signal having the same amplitude and phase as the other sensor when exposed to an acoustic wave producing the same absolute pressure at each sensor. If the dipole pair is not perfectly matched, the differential output will not be zero when both sensors are exposed to equal absolute pressure, and the dipole microphone response will begin to take on the characteristics of an omni-directional microphone. Thus, mismatched sensor pairs will degrade the noise cancelling performance of the dipole microphone by reducing both the microphone's directivity and near field/far field sensitivity ratio.

As a practical matter, a dipole sensor pair is rarely, if ever, perfectly matched due to minor production variations between each sensor. Moreover, measuring and sorting acoustic sensors to select closely matched pairs drives up the cost of the multi-sensor dipole microphone, reducing or eliminating its economic advantage over a single element dipole microphone. In addition, sensors which are closely matched at the time the dipole microphone is produced can nevertheless become mismatched over time from exposure to environmental factors such as temperature variations, moisture, dirt, mechanical shocks from being dropped, as well as from simple aging of the sensors.

Therefore, in order to provide high noise cancelling performance from low cost acoustic sensors, it is necessary to produce matched dipole elements without sorting through numerous sensors. Further, it is desirable that sensor matching be maintained as the microphone ages. Retrieving headsets to verify the noise cancelling performance and calibrate dipole microphones by switching or adjusting components is costly and burdensome, and thus is not a viable solution to the problem of mismatched dipole sensors. Because workers wearing headsets in noisy environments rely on the noise cancelling performance of the headset microphone to maintain communications, new and improved methods and systems for matching microphone elements are needed if dipole microphones using low cost acoustic sensor pairs are to be deployed in the field.

BRIEF DESCRIPTION OF THE DRAWINGS

The accompanying drawings, which are incorporated in and constitute a part of this specification, illustrate embodiments of the invention and, together with a general description of the invention given below, serve to explain the principles of the invention.

SUMMARY

In a first aspect of the invention, a microphone is constructed from two acoustic sensors spaced a distance apart. The microphone includes a sound source acoustically coupled to the sensors, and a processor configured to receive electrical signals from the sensors. The processor is further configured to calibrate the microphone by activating the sound source to produce an acoustic calibration signal. The processor receives the outputs generated by the acoustic sensors in response to the acoustic calibration signal, and determines one or more correction factors to match the outputs of the acoustic sensors.

In a second aspect of the invention, the processor generates a combined microphone output signal by filtering and subtractively combining the signals supplied by the acoustic sensors, so that the resulting output signal has the characteristics of a dipole microphone. The filter coefficients are determined by the processor based on the one more correction factors, thereby matching the outputs of the acoustic sensors so that the microphone output more closely tracks that of an ideal dipole microphone.

In a third aspect of the invention, the processor may perform the calibration periodically and update the filter coefficients, thereby maintaining the performance of the microphone over time.

DETAILED DESCRIPTION

To provide optimum noise cancelling performance, the outputs of two acoustic sensors comprising a microphone are each adaptively filtered so that the filtered responses of the sensors are matched. The filtered responses may then be combined so that the sensors form a microphone having the characteristics of a dipole microphone. However, the present invention is not limited to only dipole microphones, and microphones having other patterns may be formed. A sound source is included as a part of the microphone to provide acoustic calibration signals to the sensors comprising the dipole microphone. Periodically, the sound source may be excited with one or more calibration signals, and the responses of the sensors measured. Based on the measured responses, a processor determines one or more correction factors, which are used to generate digital filter coefficients. The digital filtering adjusts the sensor outputs, so that when the outputs are summed, they result in a differential output equivalent to that of a well matched dipole microphone.

Figure 1:
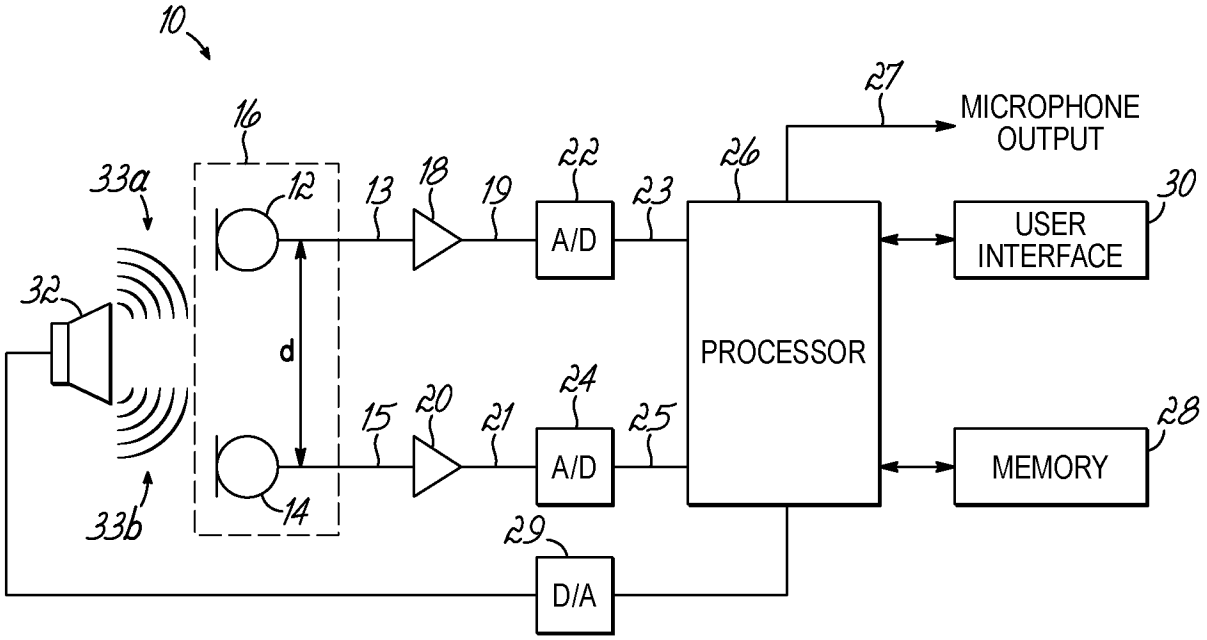
FIG. 1 is a block diagram of a self-calibrating dipole microphone in accordance with an embodiment of the invention.

With reference to FIG. 1, and in accordance with an embodiment of the invention, a block diagram of a self-calibrating dipole microphone system 10 is presented including a first acoustic sensor 12, and a second acoustic sensor 14; preamplifiers 18, 20; analog to digital (A/D) converters 22, 24; a digital to analog converter (D/A) 29, a processor 26, a memory 28, a user interface 30, and a sound source 32. The system 10 may be implemented in a headset, for example, but may be used in other devices and applications as well.

The acoustic sensors 12, 14 are omni-directional sensors of generally the same type, and may be comprised of one or more condenser elements, electret elements, piezo-electric elements, or any other suitable microphone element that generates an electrical signal in response to changes in the absolute pressure of the environment at the sensor. The acoustic sensors 12, 14 are separated by a fixed distance d, so that they form a dipole pair 16 aligned along an axis. The axis will usually be directed toward a desired sound emitter, which may be the mouth of the headset wearer. Sensors 12, 14 are electrically coupled to the preamplifiers 18, 20, which condition and buffer the acoustic sensor outputs or output signals 13, 15, before providing the amplified sensor output signals 19, 21 to the A/D converters 22, 24. Depending on the sensor type, the preamplifiers 18, 20 may also provide bias signals to the sensors 12, 14. The A/D converters 22, 24 convert the amplified sensor output signals 19, 21 into digital sensor output signals 23, 25 suitable for processing and manipulation using digital signal processing techniques, and provide the digital sensor output signals 23, 25 to the processor 26. Alternatively, the preamplifier and/or A/D functions may be integrated into the processor 26, in which case the preamplifiers 18, 20 and/or acoustic sensors 12, 14 may provide the sensor output signals directly to the processor 26.

The processor 26 may be a microprocessor, micro-controller, digital signal processor (DSP), microcomputer, central processing unit, field programmable gate array, programmable logic device, or any other device suitable for processing the audio signals from sensors 12, 14. The processor 26 is configured to receive signals from the acoustic sensors 12, 14 and to apply the necessary processing in accordance with the invention. To this end, processor 26 is configured to apply any inventive correction factors to the outputs of the acoustic sensors that might be used to provide a desirable match between the sensors. Processor 26 is also configured for filtering the signals, and then subtractively combining the filtered signals by inverting the phase of one of the signals before summing them together to generate a differential signal 27 having the characteristics of signal produced by a dipole microphone. The processor outputs the differential signal 27 for transmission to a communications system to which the microphone system 10 is connected. The differential signal 27 may be in the form of a digital signal, or the differential signal may be converted back into an analog signal depending on the requirements of the communications system in which the microphone is used.

Memory 28 may be a single memory device or a plurality of memory devices including read-only memory (ROM), random access memory (RAM), volatile memory, non-volatile memory, static random access memory (SRAM), dynamic random access memory (DRAM), flash memory, and/or any other device capable of storing digital information. The memory 28 may also be integrated into the processor 26. The memory 28 may be used to store processor operating instructions or programming code, as well as variables such as signal correction factors, filter coefficients, calibration data, and/or digitized signals in accordance with the features of the invention.

User interface 30 provides a mechanism by which an operator, such as a person wearing a headset of which the microphone system 10 is a part, may interact with the processor 26. To this end, the user interface 30 may include a keypad, buttons, a dial or any other suitable method for entering data or commanding the processor 26 to perform a desired function. The user interface 30 may also include one or more displays, lights, and/or audio devices to inform the user of the status of the microphone, the calibration status, or any other system operational parameter.

The sound source 32 may be a small voice coil driven dynamic speaker, a balanced armature, or any other device suitable for generating acoustic calibration signals 33*a*, 33*b*. The sound source 23 is acoustically coupled to the first and second acoustic sensors 12, 14, so that when the sound source 32 is activated by the processor 26, a known acoustic calibration signal 33*a*, 33*b* is provided to each acoustic sensor 12, 14.

Figure 1A:
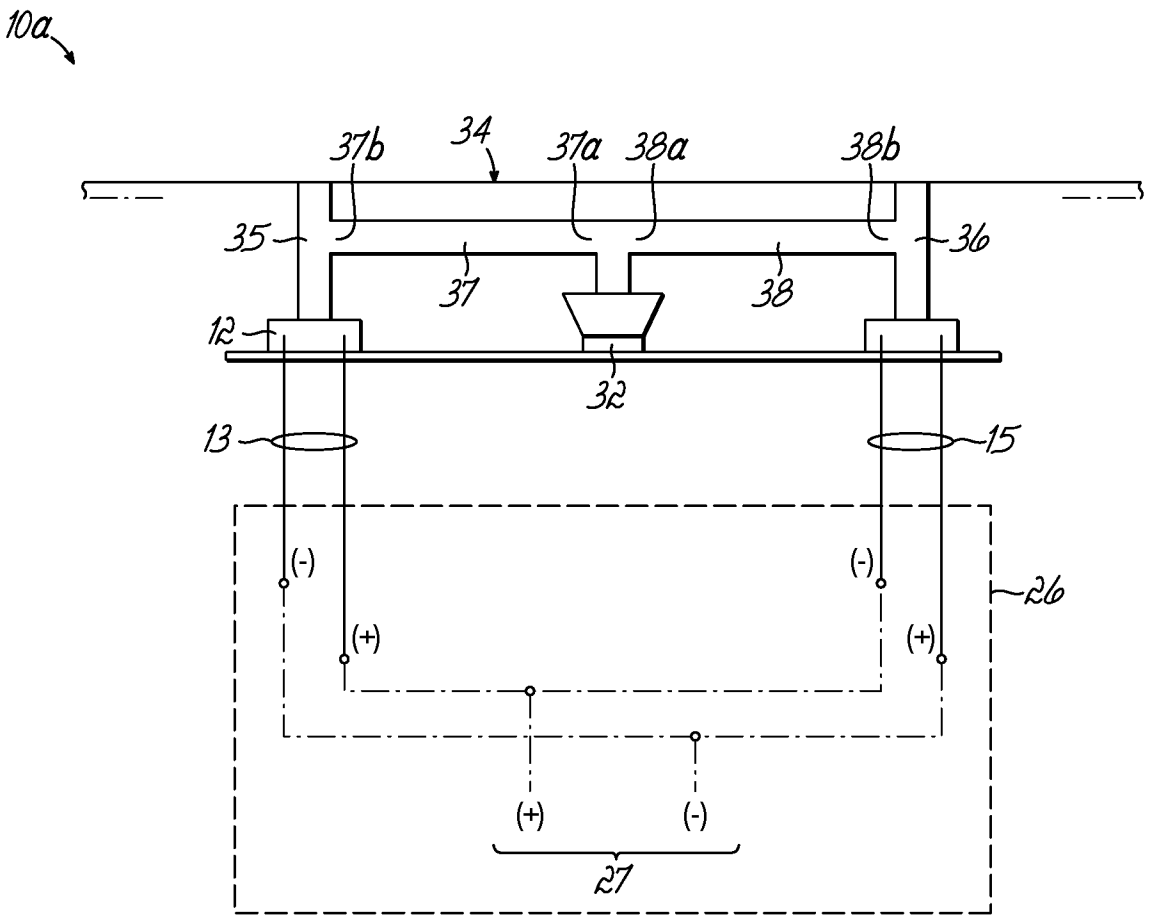
FIG. 1A is a diagram illustrating a mechanical configuration for the multi-element dipole microphone from FIG. 1 in accordance with an embodiment of the invention.

Referring now to FIG. 1A, and in accordance with an embodiment of the invention, a microphone system 10*a* is illustrated having a protective front screen, or surface 34 and sound conducting channels 35, 36 directing acoustic energy that impinges on surface 34 onto sensors 12, 14. Sensors 12, 14 are acoustically coupled to the sound source 32 by sound conducting channels 37, 38. To that end, the sound conducting channels 37, 38 have proximal ends 37*a*, 38*a* that interface with the sound source 32, and distal ends 37*b*, 38*b* that interface with respective channels 35, 36. The distal end 37*b* of sound channel 37 terminates near the first acoustic sensor 12, and the distal end 38*b* of sound channel 38 terminates near the second acoustic sensor 14. The channels 37, 38 thereby form acoustic transmission paths that transport the acoustic energy generated by the sound source 32 to the individual acoustic sensors 12, 14.

In an embodiment of the invention, the sound source 32 is located in a boom connecting the acoustic sensors 12, 14 to a headset. The channels 35-38 are configured within the boom so that each of the acoustic transmission paths formed by channels 37 and 38 terminates at a location disposed between the channel's respective acoustic sensor 12, 14 and the sensor's protective front surface 34. In another embodiment of the invention, the acoustic coupling is configured so that acoustic signals 33*a*, 33*b* (FIG. 1) have the same phase and amplitude at each acoustic sensor 12, 14. To this end, the sound source 32 may be located equidistant from the sensors 12, 14 so that the acoustic transmission paths formed by channels 37, 38 have the same length.

So that the differential signal 27 has the characteristics of a signal produced by a dipole microphone, the output signals 13, 15 of acoustic sensors 12, 14 are combined in the processor 26. The processor 26 subtracts the second signal 15 from the first signal 13, which is the same as inverting the signal 15 from the second acoustic sensor and adding it to the signal 13 from the first acoustic sensor 12. Because the signals 13, 15 are combined within the processor 26, the signals 13, 15 may be digitally processed by the processor 26 prior to combining them. In embodiments of the invention, this signal processing may be used to improve the performance of the microphone based on correction factors determined from the response of acoustic sensors 12, 14 to the calibration signals 33*a*, 33*b* produced by sound source 32.

Figure 2:
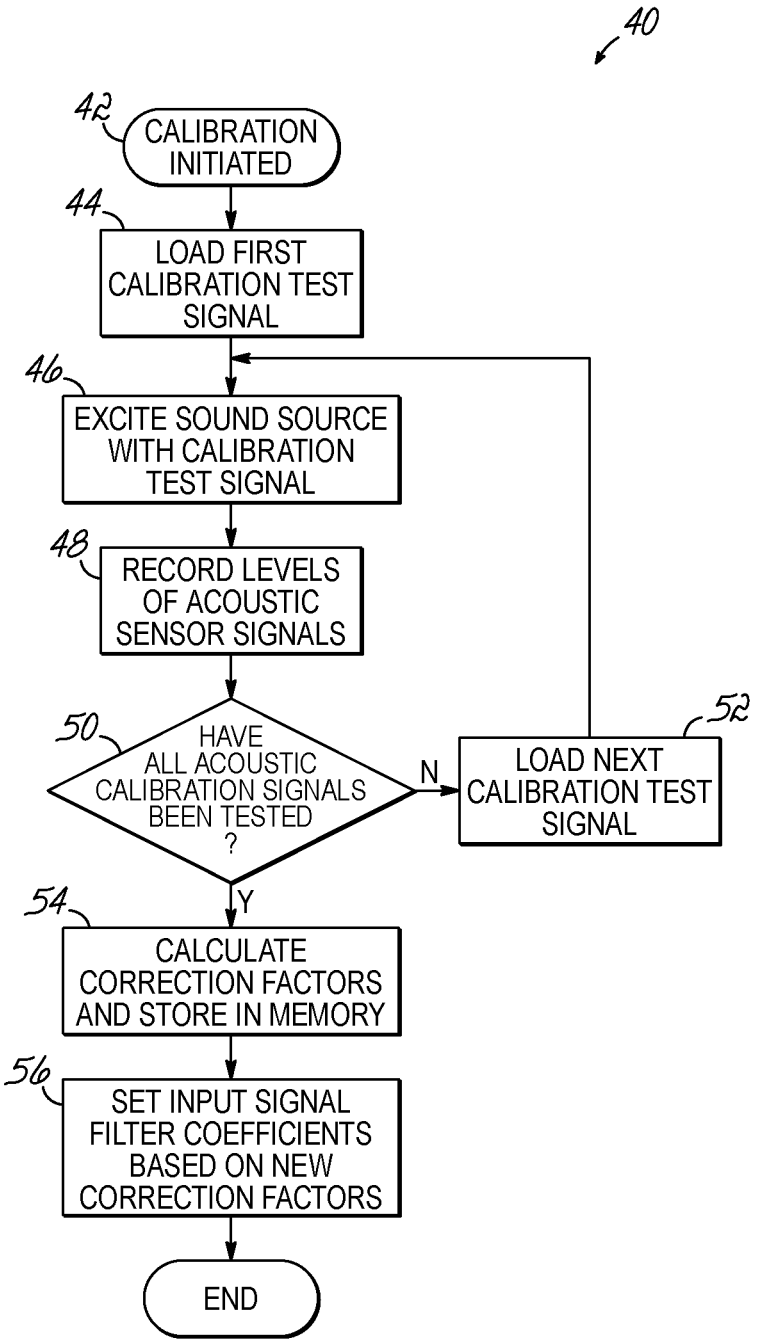
FIG. 2 is a flow chart detailing a self-calibration procedure in accordance with an embodiment of the invention.

Referring now to FIG. 2, and in accordance with an embodiment of the invention, a flowchart 40 illustrating a self-calibration process is presented. In block 42, a self-calibration process may be initiated by the processor 26, or by a user entering a command through the user interface 30. The processor 26 may initiate the calibration procedure in response to a power on event, or in response to a remote command received from a centralized computer system, or based on a timed event or schedule, or upon detecting an abnormal condition in the self-calibrating dipole microphone system 10, or for any other reason that would call for a microphone calibration. In block 44, the processor 26 loads a first calibration test signal. The calibration test signal may consist of a single tone, multiple tones, or any other suitable calibration signal, such as white noise. The calibration test signal may be from a digital file stored in memory 28 representing an analog waveform, or may be generated directly by the processor 26, such as by a mathematical formula. In block 46, the processor 26 activates the sound source 32 by exciting it with the loaded calibration test signal. The calibration test signal may be converted to an analog signal suitable for exciting the sound source by the D/A converter 29. Alternatively, the D/A function may be integrated into the processor 26, in which case the processor 26 may provide the calibration test signal directly to the sound source 32. In yet another alternative embodiment, the sound source 32 may produce the calibration test signal internally in response to an activation signal from the processor 26. The processor 26, D/A converter 29, and sound source 32 may be collectively configured to provide the acoustic calibration signals 33*a*, 33*b* at an energy level sufficient to overwhelm the normal ambient noise level encountered by the dipole microphone system 10 in its expected operational environment. This allows the calibration process to be conducted at any time while the dipole microphone system 10 is operational without the calibration being affected significantly by ambient noise. Alternatively, the processor 26 may adjust the acoustic calibration signal level based on a detected level of ambient noise.

At block 48, the processor 26 records the responses of the various acoustic sensors 12, 14 to the acoustic calibration signals 33*a*, 33*b* by measuring the output levels of the output from the sensors 12, 14 in response to acoustic test signals 33*a*, 33*b*. The measured output levels of the output signals 23, 25 are stored in memory 28. The levels or other captured information of signals 23, 25 may include amplitude information, phase information, or may include both amplitude and phase information about the calibration output signals 23, 25. In block 50, the processor determines if all calibration test signals have been tested. If all the calibration test signals have not been tested, ("No" branch of decision block 50), the processor 26 loads the next calibration test signal at block 52 and returns to block 46, repeating the calibration measurement with the new calibration test signals at the outputs 23, 25 from the sensors 12, 14. In an embodiment of the invention, the new calibration test signal may be, for example, a single tone at a different frequency than the earlier calibration test signals. If all the calibration test signals have been tested and the sensor outputs from those signals captured and stored, ("Yes" branch of decision block 50), the processor 26 proceeds to block 54.

At block 54, the processor 26 calculates correction factors to effectively match the outputs of the first and second acoustic sensors 12, 14. The processor 26 compares the measured output levels of each acoustic sensor 12, 14 at each calibration test frequency or signal. By such comparison, the processor can determine the differences in the amplitude and/or phase of the signals that are measured by the sensors 12, 14 in response to calibration signals 33*a*, 33*b*. One or both of the sensors 12, 14, or specifically the output calibration measurement signals provided by each sensor, may need to be adjusted in amplitude and/or phase in order to match the effective output signals of the sensors. This is done by processing, as the sensors will have unique characteristic output features. The processor determines a correction factor to apply to one or both of the sensor output signals 23, 25 so that the output levels are effectively matched. The correction factor scales the levels of the corrected signals, so that the corrected output levels of the signals from the sensors 12, 14 are within a specified matching tolerance for that calibration test frequency or signal. The correction factor may adjust the output levels of both the relative phase and amplitude of one or more of the sensor output signals 23, 25 so that both the phase and amplitude of the output signals 23, 25 are matched. Alternatively, the correction factor may adjust only one of either the phase or amplitude. The correction factor may be calculated for a single frequency, for multiple frequencies, or for one or more test signals having multiple frequencies. After the one or more correction factors are determined for the one or more sensors 12, 14, the correction factors may be stored in memory 28.

In block 56, the processor 26 calculates input filter coefficients based on the correction factors so that the correction factors may be applied to the sensor output signals 23, 25. The filter coefficients are used by the processor 26 to digitally process—or filter—the sensor output signals 23, 25 prior to subtractively combining the processed signals to form the differential signal 27 as illustrated in FIG. 1A. In the case where there is only a single correction factor, the filter may simply provide a gain adjustment, a phase adjustment, or a gain and phase adjustment, to one or both of the sensor output signals 23, 25, so that the outputs are matched. Where there are multiple correction factors at different frequencies, the input filter is configured to alter the phase and/or frequency response of the sensor output signals 23, 25 by adjusting the gain and/or phase applied to the sensor output signals 23, 25 on a frequency selective basis. In this way, the filtered sensor output signal levels may be matched across multiple frequencies prior to being subtractively combined to form the differential signal 27. The design of frequency selective filters using digital signal processing techniques is understood by those having ordinary skill in the art of digital signal processing, and the calculation of the filter coefficients to obtain the desired frequency response may thus be made using known methods in accordance with one aspect of the invention.

Optionally, the dipole pair calibration may be verified by the processor 26 by outputting the calibration test signals with the new filter coefficients in place, and measuring the resulting level of the differential signal 27. The dipole pair calibration will typically be verified immediately after a new calibration has been performed, but may be verified at any time during the operation of the microphone, for example, to determine if a new calibration is required.

Figure 3:
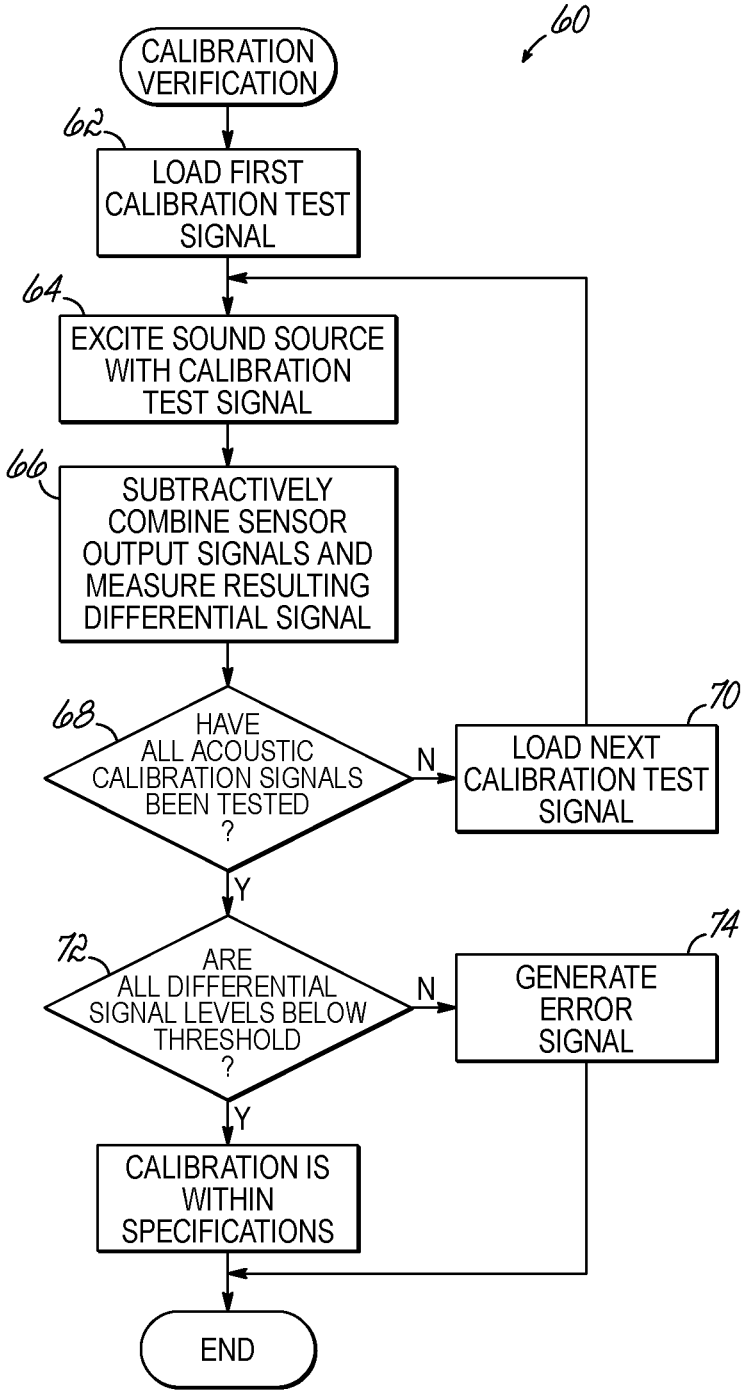
FIG. 3 is a flow chart of a calibration verification procedure in accordance with an embodiment of the invention.

Referring now to FIG. 3, and in accordance with an embodiment of the invention, a flow chart is presented illustrating a calibration verification process 60. In blocks 62 and 64, the processor 26 loads the first calibration test signal and excites the sound source 32 with the first calibration test signal in a similar manner as for the dipole pair calibration as described with respect to FIG. 2. In block 66, the processor 26 conditions the sensor output signals 23, 25 by processing them through their respective digital filters using the digital filter coefficients determined during step 56 of the most recent calibration process. The conditioned signals are then subtractively combined to produce a differential signal, the level of which may be stored in memory 28. In block 68, the processor 26 determines if all the calibration test signals have been tested. If all the calibration test signals have not been tested, ("No" branch of decision block 68), the processor 26 loads the next calibration test signal at block 70 and returns to block 64, repeating the calibration verification measurement with the next test signal. If all the calibration test signals have been tested, ("Yes" branch of decision block 68), the processor 26 proceeds to block 72.

In block 72, the processor determines if the matching tolerance is met at each calibration test frequency by comparing the stored differential signal level for that calibration test frequency with its respective matching tolerance threshold level. If any of the measured differential signal levels is above the allowable matching tolerance threshold for the associated calibration signal ("No" branch of decision block 72), the processor proceeds to block 74, where it generates an error signal. The error signal may indicate that the sensors 12, 14 may be so mismatched that they cannot be corrected and matched, or that it is not desirable to try and match them. For example, one of the sensors might be defective. The matching tolerance threshold levels may be preset, or may be adjustable so that an acceptable level of noise cancellation can be set by the microphone user or system administrator.

The error signal may cause the user interface 30 to indicate that a calibration error has occurred, such as by activating an indicator on a display or light emitting diode (LED), or by generating an audio alert or voice prompt. In cases where the microphone is part of a headset, the audio alert or voice prompt could be also be provided to the user through the headset earphone(s). The error signal may also be transmitted to a central computer system, so that a communications system administrator is alerted to the malfunctioning microphone. When the error signal is sent to a central computer system, it may contain a serial number or other identifying information, so that the headset or other device to which the microphone is attached may be located and either repaired or taken out of service. If none of the measured differential signal levels are above the allowable matching tolerance for the associated calibration signal ("Yes" branch of decision block 72), the calibration is considered to be within specifications, and the system may resume normal operation.

The self-calibrating dipole microphone 10 thus provides improved performance over the life of the microphone by regularly adjusting the relative outputs of the acoustic sensors 12, 14 forming the dipole pair 16. Advantageously, because the microphone can regularly optimize its performance as environmental factors and age alter the properties of the matched elements, the self-calibrating dipole microphone may offer better performance than a dipole microphone relying on acoustic sensors matched only at the time of manufacture. This feature is particularly advantageous for microphones used in harsh work environments, which may cause elements to become mismatched from exposure to harsh conditions, dirt, mechanical shock, and electrostatic discharges (ESD). More advantageously, because the self-calibration reduces the need for acoustic sensor elements to be carefully measured and sorted into matched pairs at the time of manufacture, the cost of parts and labor for producing the microphone may be significantly reduced. The embodiments of the invention are thus particularly suited to providing high performance noise cancelling microphones in cost sensitive applications.

While the invention has been illustrated by a description of various embodiments, and while these embodiments have been described in considerable detail, it is not the intention of the applicant to restrict or in any way limit the scope of the appended claims to such detail. Additional advantages and modifications will readily appear to those skilled in the art. The invention in its broader aspects is therefore not limited to the specific details, representative methods, and illustrative examples shown and described. Accordingly, departures may be made from such details without departing from the spirit or scope of applicant's general inventive concept.

The invention claimed is:

1. A microphone, comprising:

a first acoustic sensor having a first output;

a second acoustic sensor having a second output;

a sound source acoustically coupled to the first and second acoustic sensors, the sound source comprising an input;

an enclosed sound conducting channel spanning continuously from the sound source to the first acoustic sensor and the second acoustic sensor, the enclosed sound conducting channel forming a first acoustic transmission path from the sound source to the first acoustic sensor and a second acoustic transmission path from the sound source to the second acoustic sensor;

a processor electrically coupled to the input, the first output, and the second output, the processor being configured for:

activating the sound source to produce an acoustic calibration signal;

receiving a first output from the first acoustic sensor generated in response to the acoustic calibration signal;

receiving a second output from the second acoustic sensor generated in response to the acoustic calibration signal; and determining one or more correction factors based on the received first output and the received second output.

2. The microphone of claim 1, wherein the enclosed sound conducting channel comprises:

a first channel having a proximal end at the sound source and a distal end at the first acoustic sensor, the first channel configured to convey a portion of the acoustic calibration signal from the sound source to the first acoustic sensor; and a second channel continuous with the first channel and having a proximal end at the sound source and a distal end at the second acoustic sensor, the second channel configured to convey a portion of the acoustic calibration signal from the sound source to the second acoustic sensor.

3. The microphone of claim 2, wherein the first and second channels are configured so that the conveyed portions of the acoustic calibration signal have substantially the same phase and amplitude at the first and second acoustic sensors.

4. The microphone of claim 2, comprising a housing having a first opening configured to admit sound to the first acoustic sensor and a second opening configured to admit sound to the second acoustic sensor, wherein:

the first channel is configured so that its distal end terminates at a point between the first opening and the first acoustic sensor; and the second channel is configured so that its distal end terminates at a point between the second opening and the second acoustic sensor.

5. The microphone of claim 1, wherein:

the first acoustic transmission path and the second acoustic transmission path have the same length; and the first and second acoustic sensors are equidistant from the sound source.

6. The microphone of claim 1, wherein the processor is configured for:

filtering the output from the first acoustic sensor and the output from the second acoustic sensor; and subtractively combining the filtered outputs to generate a composite output signal having the characteristics of a dipole microphone.

7. A headset, comprising:

a first acoustic sensor having a first output;

a second acoustic sensor having a second output;

a boom configured to hold the first acoustic sensor and the second acoustic sensor along an axis;

a sound source acoustically coupled to the first and second acoustic sensors by an enclosed sound conducting channel spanning continuously from the sound source to the first and second acoustic sensors, the enclosed sound conducting channel forming a first acoustic transmission path from the sound source to the first acoustic sensor and a second acoustic transmission path from the sound source to the second acoustic sensor, the sound source comprising an input; and a processor electrically coupled to the input, the first output, and the second output, the processor being configured for:

activating the sound source to produce an acoustic calibration signal;

receiving a first output from the first acoustic sensor generated in response to the acoustic calibration signal;

receiving a second output from the second acoustic sensor generated in response to the acoustic calibration signal; and determining one or more correction factors based on the received first output and the received second output.

8. The headset of claim 7, wherein the sound source is integrated with the boom.

9. The headset of claim 8, wherein the boom comprises:

a first opening configured to admit sound to the first acoustic sensor;

a second opening configured to admit sound to the second acoustic sensor;

a first channel having a proximal end at the sound source and a distal end at a point between the first opening and the first acoustic sensor so that a portion of the acoustic calibration signal is conveyed from the sound source to the first acoustic sensor; and a second channel having a proximal end at the sound source and a distal end at a point between the second opening and the second acoustic sensor so that a portion of the acoustic calibration signal is conveyed from the sound source to the second acoustic sensor.

10. The headset of claim 7, wherein the processor is configured for:

filtering the output from the first acoustic sensor and the output from the second acoustic sensor; and subtractively combining the filtered outputs to generate a composite output signal having the characteristics of a dipole microphone.

11. The headset of claim 10, wherein the processor is configured for determining filter coefficients based on the one more correction factors, wherein the filter coefficients are used to filter the first and second acoustic sensor outputs.

12. A method of matching a pair of acoustic sensors, the method comprising:

generating an acoustic calibration signal with a sound source;

transmitting the acoustic calibration signal to first and second acoustic sensors via continuous acoustic transmission paths formed by enclosed sound conducting channels spanning from the sound source to each of the first acoustic sensor and the second acoustic sensor;

measuring a response signal of the first acoustic sensor to the acoustic calibration signal;

measuring a response signal of the second acoustic sensor to the acoustic calibration signal;

determining a correction factor based on the response signals of the first and second acoustic sensors to the acoustic calibration signal; and applying the correction factor to signals produced by the first acoustic sensor and/or the second acoustic sensor so that the responses of the first and second sensors are matched.

13. The method of claim 12, wherein the acoustic calibration signal comprises a plurality of frequencies.

14. The method of claim 13, wherein only one frequency of the plurality of frequencies is generated at a time.

15. The method of claim 12, wherein the step of the correction factor to signals produced by the first acoustic sensor and/or the second acoustic sensor comprises:

calculating a digital filter coefficient based on the correction factor; and filtering the signals produced by the first acoustic sensor and/or the second acoustic sensor using the digital filter coefficient.

16. The method of claim 12, comprising:

inverting the phase of either the first acoustic sensor response signal or the second acoustic sensor response signal to produce an inverted acoustic sensor response signal and a non-inverted acoustic sensor response signal;

summing the inverted acoustic sensor response signal with the non-inverted acoustic sensor response signal to generate a summed output;

comparing the summed output to a threshold;

in response to an amplitude of the summed output being at or below the threshold, making a determination that the acoustic sensors are calibrated; and in response to the amplitude of the summed output being above the threshold, making a determination that the acoustic sensors are not calibrated.

17. The method of claim 16, comprising generating an error signal if a determination is made that the acoustic sensors are not calibrated.

18. The method of claim 17, comprising communicating the error signal to a central computer system.

19. The method of claim 17, comprising activating an indicator when the error signal is generated.

20. The method of claim 17, comprising alerting a user that the acoustic sensors are not calibrated when the error signal is generated.

* * * * *